US010783870B1

(12) United States Patent
He et al.

(10) Patent No.: US 10,783,870 B1
(45) Date of Patent: Sep. 22, 2020

(54) AUDIO PLAYBACK DEVICE AND METHOD HAVING NOISE-CANCELLING MECHANISM

(71) Applicant: Realtek Semiconductor Corporation, Hsinchu (TW)

(72) Inventors: Wei-Hung He, Hsinchu (TW); Chun-Ming Cho, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 16/689,263

(22) Filed: Nov. 20, 2019

(30) Foreign Application Priority Data

Jul. 24, 2019 (TW) ..... 108126229 A

(51) Int. Cl.
*G10K 11/178* (2006.01)

(52) U.S. Cl.
CPC .. *G10K 11/17854* (2018.01); *G10K 11/17823* (2018.01); *G10K 11/17825* (2018.01); *G10K 11/17881* (2018.01); *G10K 2210/3028* (2013.01); *G10K 2210/3044* (2013.01)

(58) Field of Classification Search
CPC ..... G10K 11/17854; G10K 11/17881; G10K 11/17823; G10K 11/17825; G10K 2210/3044; G10K 2210/3028
See application file for complete search history.

(56) References Cited

U.S. PATENT DOCUMENTS 8,693,700 B2 4/2014 Bakalos et al.
8,718,289 B2 5/2014 Shridhar et al.
9,741,332 B2 8/2017 Asada
2005/0053244 A1 3/2005 Onishi et al.
2016/0171962 A1* 6/2016 Jenkins ..... G10K 11/175 381/71.6

(Continued)

OTHER PUBLICATIONS

Dan Harris et al., "An Infinite Impulse Response (IIR) Hilbert Transformer Filter Design Technique for Audio", Audio Engineering Society Convention Paper, Nov. 6, 2010.

(Continued)

*Primary Examiner* — Regina N Holder
(74) *Attorney, Agent, or Firm* — Locke Lord LLP; Tim Tingkang Xia, Esq.

(57) ABSTRACT

An audio playback device having a noise-cancelling mechanism is provided that includes an external sound-receiving circuit that receives external noise, a fixed-coefficient filtering circuit, an operation circuit, an audio playback circuit, an internal sound-receiving circuit and an adjusting circuit. The fixed-coefficient filtering circuit generates an inverted signal including a main and an auxiliary inverted components having the same amplitude and phases orthogonal to each other according to the external noise. The operation circuit multiplies the inverted signal by adjusting parameters to generate an adjusted inverted signal. The audio playback circuit receives and playbacks an audio signal and the adjusted inverted signal to generate a playback result. The internal sound-receiving circuit receives the playback result to generate a received sound signal. The adjusting circuit generates the adjusting parameters according to an error signal between the received sound signal and the audio signal and the inverted signal.

10 Claims, 7 Drawing Sheets

(56) References Cited

U.S. PATENT DOCUMENTS

| | | | | |
|---|---|---|---|---|
| 2018/0144736 | A1* | 5/2018 | Huang | H04R 1/1083 |
| 2018/0190259 | A1* | 7/2018 | Woelfl | H04S 7/304 |
| 2019/0268687 | A1* | 8/2019 | Farahanisamani | G10K 11/17873 |
| 2019/0387306 | A1* | 12/2019 | He | H04R 1/105 |
| 2020/0193955 | A1* | 6/2020 | Hsu | G10K 11/17854 |

OTHER PUBLICATIONS

Dah-Chung Chang et al., "Feedforward Active Noise Control With a New Variable Tap-Length and Step-Size Filtered-X LMS Algorithm", IEEE/ACM Transactions on Audio, Speech, and Language Processing, vol. 22, No. 2, pp. 542-555, Jan. 6, 2014.

* cited by examiner

AUDIO PLAYBACK DEVICE AND METHOD HAVING NOISE-CANCELLING MECHANISM

RELATED APPLICATIONS

This application claims priority to Taiwan Application Serial Number 108126229, filed Jul. 24, 2019, which is herein incorporated by reference.

BACKGROUND

Field of Disclosure

The present disclosure relates to an audio playback technology. More particularly, the present disclosure relates to an audio playback device and an audio playback method having a noise-cancelling mechanism.

Description of Related Art

People often use earphone to listen to music. However, external noise may also enter the ears to keep the user from hearing the music clearly. In order to avoid the interference of the noise, earphones equipped with noise-cancelling function are presented.

Common earphones having the noise-cancelling function often use earplugs and earpads to keep the environment sound from entering the ears. Such a passive way to cancel the noise can lower the intensity of the noise for 15~25 dB in an ideal condition but cannot cancel the low frequency noise. As a result, the earphones adapting new technology use active noise-canceling mechanism by generating a signal to cancel the noise. However, the direction of the signal generated accordingly cannot match the noise such that the efficiency of the noise-canceling cannot be improved.

Accordingly, what is needed is an audio playback device and an audio playback method having a noise-cancelling mechanism to address the above issues.

SUMMARY

An aspect of the present disclosure is to provide an audio playback device having a noise-cancelling mechanism that includes an external sound-receiving circuit, a fixed-coefficient filtering circuit, an operation circuit, an audio playback circuit, an internal sound-receiving circuit and an adjusting circuit. The external sound-receiving circuit is disposed outside of a housing and is configured to receive external noise. The fixed-coefficient filtering circuit is configured to generate an inverted signal that includes a main inverted component and an auxiliary inverted component having amplitudes that are substantially the same and phases that are substantially orthogonal to each other according to the external noise. The operation circuit is configured to multiply the inverted signal by a group of adjusting parameters to generate an adjusted inverted signal, wherein the group of adjusting parameters includes a first adjusting parameter configured to adjust the main inverted component and a second adjusting parameter configured to adjust the auxiliary inverted component. The audio playback circuit is disposed inside of the housing and is configured to receive and playback an audio signal and the adjusted inverted signal to generate a playback result; an internal sound-receiving circuit disposed inside the housing and configured to receive the playback result to generate a received sound signal. The adjusting circuit is configured to generate the adjusting parameters according to an error signal between the received sound signal and the audio signal and the inverted signal by using an optimization algorithm.

Another aspect of the present disclosure is to provide an audio playback method having a noise-cancelling mechanism used in an audio playback device that includes the steps outlined below. External noise is received by an external sound-receiving circuit disposed outside of a housing; generating an inverted signal by a fixed-coefficient filtering circuit that includes a main inverted component and an auxiliary inverted component having amplitudes that are substantially the same and phases that are substantially orthogonal to each other according to the external noise. The inverted signal is multiplied by a group of adjusting parameters by an operation circuit to generate an adjusted inverted signal, wherein the group of adjusting parameters includes a first adjusting parameter configured to adjust the main inverted component and a second adjusting parameter configured to adjust the auxiliary inverted component. An audio signal and the adjusted inverted signal are received and played by an audio playback circuit disposed inside of the housing to generate a playback result. The playback result is received by an internal sound-receiving circuit disposed inside the housing to generate a received sound signal. The adjusting parameters are generated according to an error signal between the received sound signal and the audio signal and the inverted signal by an adjusting circuit by using an optimization algorithm.

These and other features, aspects, and advantages of the present disclosure will become better understood with reference to the following description and appended claims.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1A:
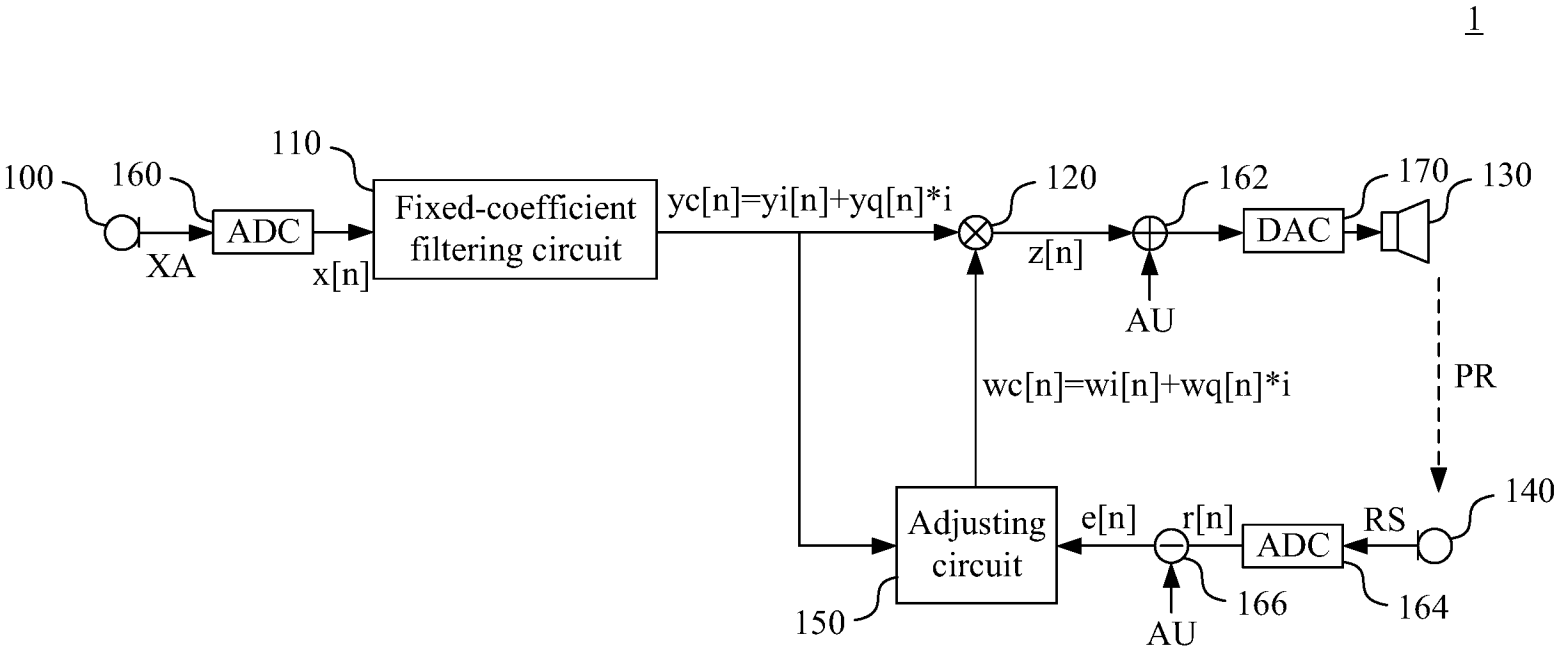
FIG. 1A and FIG. 1B are respectively block diagrams of an audio playback device having a noise-cancelling mechanism in an embodiment of the present invention.

Reference will now be made in detail to the present embodiments of the disclosure, examples of which are illustrated in the accompanying drawings. Wherever possible, the same reference numbers are used in the drawings and the description to refer to the same or like parts.

Figure 1B:
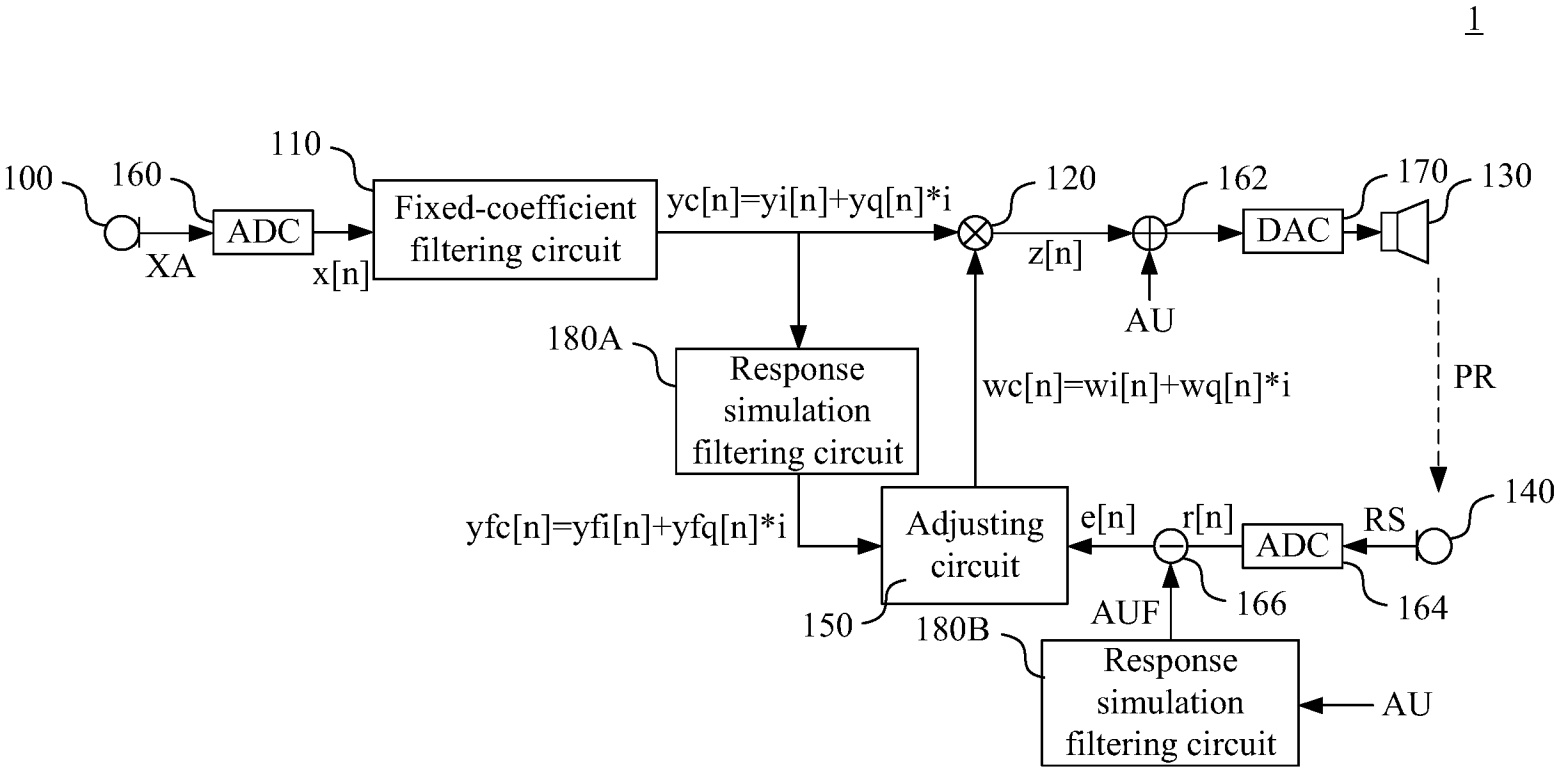

Reference is now made to FIG. 1A and FIG. 1B at the same time. FIG. 1A and FIG. 1B are respectively block diagrams of an audio playback device 1 having a noise-cancelling mechanism in an embodiment of the present invention. The audio playback device 1 includes an external sound-receiving circuit 100, a fixed-coefficient filtering circuit 110, an operation circuit 120, an audio playback circuit 130, an internal sound-receiving circuit 140 and an adjusting circuit 150.

In an embodiment, the audio playback device 1 is an earphone having a physical housing (not illustrated), wherein the external sound-receiving circuit 100 is disposed outside of the housing and the operation circuit 120, the audio playback circuit 130, the internal sound-receiving circuit 140 and the adjusting circuit 150 are disposed in the housing.

The external sound-receiving circuit 100 is disposed outside of a housing and is configured to receive external noise XA in the analog form such that an analog to digital conversion circuit 160 included in the audio playback device 1 (labeled as ADC in FIG. 1A and FIG. 1B) performs analog to digital conversion thereon to generate external noise x[n] in the digital form, in which n can be integers not smaller than 0 and represents the sampling result of the external noise XA corresponding to different time spots.

The fixed-coefficient filtering circuit 110 is configured to generate an inverted signal yc[n] according to the external noise x[n]. The inverted signal yc[n] includes a main inverted component yi[n] and an auxiliary inverted component yq[n]. In an embodiment, the inverted signal yc[n] can be expressed by a complex number including the main inverted component yi[n] and the auxiliary inverted component yq[n]: yc[n]=yi[n]+yq[n]*i.

The auxiliary inverted component yq[n] and the main inverted component yi[n] has amplitudes that are substantially the same and phases that are substantially orthogonal to each other.

It is appreciated that the term "substantially" means that the amplitudes of the main inverted component yi[n] and the auxiliary inverted component yq[n] are not necessarily completely the same and may include an error therebetween in a reasonable range. Further, the phases thereof are not necessarily completely orthogonal and may include an error therebetween in a reasonable range. However, it is noted that the phase of the auxiliary inverted component yq[n] can either lead the phase of the main inverted component yi[n] by 90 degrees or fall behind the phase of the main inverted component yi[n] by 90 degrees. The phase of the auxiliary inverted component yq[n] is considered as being orthogonal to the phase of the main inverted component yi[n] in both the situations described above.

In practical implementation, the fixed-coefficient filtering circuit 110 may include two filtering circuits both having fixed coefficients respectively generate the main inverted component yi[n] and the auxiliary inverted component yq[n] according to the external noise x[n]. In another embodiment, the fixed-coefficient filtering circuit 110 may include a filtering circuit that generates the main inverted component yi[n] first and another filtering circuit that generates the auxiliary inverted component yq[n] by performing Hilbert Transform on the main inverted component yi[n]. In yet another embodiment, the fixed-coefficient filtering circuit 110 may include a filtering circuit that generates a first stage of filtering result and two filtering circuits respectively generate the main inverted component yi[n] and the auxiliary inverted component yq[n] by performing filtering on the first stage of filtering result. The present invention is not limited thereto.

The operation circuit 120 is configured to multiply the inverted signal yc[n] by a group of adjusting parameters wc[n] to generate an adjusted inverted signal z[n]. In an embodiment, the group of adjusting parameters wc[n] include a first adjusting parameter wi[n] and a second adjusting parameter wq[n], wherein the adjusting parameters wc[n] can be expressed by a complex number including the first adjusting parameter wi[n] and the second adjusting parameter wq[n]: wc[n]=wi[n]+wq[n]*i.

In an embodiment, the operation performed by the operation circuit 120 is to conjugate the inverted signal yc[n] and multiply the conjugated result by the adjusting parameters wc[n]. Further, the real part of the multiplication result is retrieved to obtain the adjusted inverted signal z[n]. The operation described above is expressed by the following equation:

$$z[n]=Re(\mathrm{conj}(yc[n])*wc[n])=yi[n]*wi[n]+yq[n]*wq[n]$$

It is appreciated that in order to perform illustration, the operation circuit 120 in FIG. 1A and FIG. 1B is merely illustrated as a multiplier. However, in practical implementation, the operation circuit 120 may be implemented by a combination of such as, but not limited to a multiplier, an adder or other hardware operation circuit to perform the operation described above. The present invention is not limited to any specific circuit configuration.

The audio playback circuit 130 is configured to receive and playback an audio signal AU and the adjusted inverted signal z[n] to generate a playback result PR.

In an embodiment, the audio signal AU and adjusted inverted signal z[n] can be received and added by an adder 162 and can be transmitted to the audio playback circuit 130. Further, in an embodiment, a digital to analog conversion can be performed on the added audio signal AU and adjusted inverted signal z[n] by a digital to analog conversion circuit 170 (labeled as DAC in FIG. 1A and FIG. 1B) included in the audio playback device 1 such that the converted result is playback by the audio playback circuit 130.

The internal sound-receiving circuit 140 is configured to receive the playback result PR to generate a received sound signal RS. An analog to digital conversion can be performed on the received sound signal RS by an analog to digital conversion circuit 164 (labeled as ADC in FIG. 1A and FIG. 1B) included in the audio playback device 1 to generate a received sound signal r[n] in the digital form, in which n can be integers not smaller than 0 and represents the sampling result of the received sound signal RS corresponding to different time spots.

As illustrated in FIG. 1A, the adjusting circuit 150 is configured to generate the adjusting parameters wc[n] according to an error signal e[n] between the received sound signal r[n] and the audio signal AU and the inverted signal yc[n] by using an optimization algorithm.

In an embodiment, the error signal e[n] can be generated by subtracting the received sound signal r[n] by the audio signal AU by using a subtractor 166 included in the audio playback device 1.

In an embodiment, after the playback result PR of the audio playback circuit 130 is transmitted to the internal sound-receiving circuit 140, the received sound signal RS does not equal to the playback result PR due to the transmission path between the audio playback circuit 130 and the internal sound-receiving circuit 140 and the characteristic of the internal sound-receiving circuit 140 itself. The received sound signal r[n] and the error signal e[n] generated subsequently are further affected.

Due to the issues described above, the audio playback device 1 may further include response simulation filtering circuits 180A and 180B illustrated in FIG. 1B in order to generate the adjusting parameters wc[n] more accurately.

The response simulation filtering circuit 180A is configured to filter the inverted signal yc[n] according to a frequency response S(z) from the audio playback circuit 130 to the internal sound-receiving circuit 140 to generate a filtered inverted signal yfc[n]. The filtered inverted signal yfc[n] also includes a main inverted component yfi[n] and an auxiliary inverted component yfq[n] and can be expressed as a complex number of yfc[n]=yfi[n]+yfq[n]*i.

On the other hand, the response simulation filtering circuit 180B is configured to filter the audio signal AU according to the frequency response S(z) to generate a filtered audio signal AUF. The error signal e[n] is actually generated by subtracting the received sound signal r[n] by the audio signal AUF.

After the filtering is performed, the adjusting circuit 150 is substantially configured to generate the adjusting parameters wc[n] according to the error signal e[n] and the feed-forward filtered inverted signal yfc[n] by using the optimization algorithm.

In an embodiment, the optimization algorithm is a least mean square (LMS) algorithm, and the adjusting circuit 150 is a LMS algorithm processing circuit to operate the LMS algorithm.

More specifically, taking the configuration of FIG. 1B as an example, the adjusting circuit 150 can generate the adjusting parameters by using the following equation:

$$wc[n+1]=wc[n]-\mu*e[n]*yfc[n]$$

wc[n+1] is the adjusting parameter that is behind wc[n] for one time spot. μ is a constant that can be set to determine whether the error of such a filter converges and the speed of convergence.

The operation circuit 120 can generate an adaptive adjusted inverted signal z[n] by using the feed-forward mechanism described above that allows the audio playback circuit 130 cancels the external noise XA by playback the adjusted inverted signal z[n] to accomplish the noise-canceling mechanism.

The noise-canceling mechanism of the adjusted inverted signal z[n] that cancels the external noise XA is described in the following paragraphs.

Figure 2:
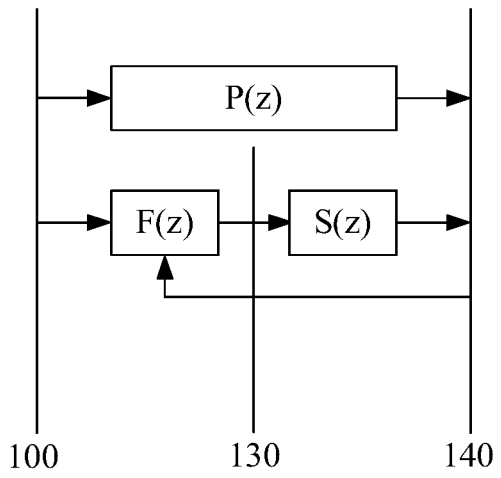
FIG. 2 is a diagram of the response between the external sound-receiving circuit, the audio playback circuit and the internal sound-receiving circuit in an embodiment of the present invention.

Reference is now made to FIG. 2. FIG. 2 is a diagram of the response between the external sound-receiving circuit 100, the audio playback circuit 130 and the internal sound-receiving circuit 140 in an embodiment of the present invention.

As illustrated in FIG. 2, the response of the path of the external noise XA received from the external sound-receiving circuit 100 to the internal sound-receiving circuit 140 is P(z). The response of the path from the audio playback circuit 130 to the internal sound-receiving circuit 140 is S(z). As a result, in order to cancel the external noise XA, the ideal response F(z) of the path for the fixed-coefficient filtering circuit 110 is −P(z)/S(z). However, since the F(z) must be causal, F(z) can only be approximate to −P(z)/S(z) and cannot be equal to −P(z)/S(z).

As a result, the main inverted component yi[n] generated by the fixed-coefficient filtering circuit 110 is equal to F(z) and the auxiliary inverted component yq[n] serves as a compensation for the main inverted component yi[n] to generate a result closest to −P(z)/S(z).

Figure 3:
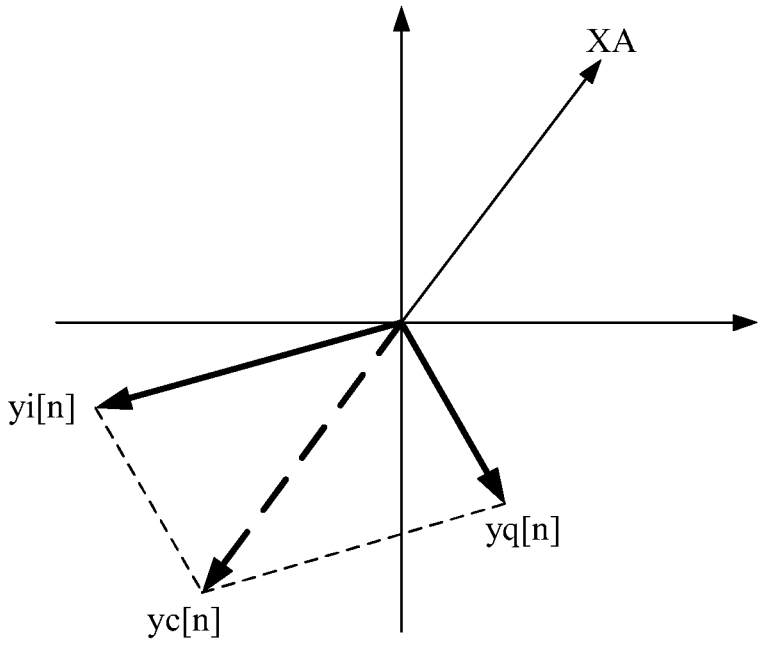
FIG. 3 is a diagram of the external noise, the main inverted component, the auxiliary inverted component and the inverted signal in an embodiment of the present invention.

Reference is now made to FIG. 3. FIG. 3 is a diagram of the external noise XA, the main inverted component yi[n], the auxiliary inverted component yq[n] and the inverted signal yc[n] in an embodiment of the present invention.

As illustrated in FIG. 3, since the main inverted component yi[n] is not ideal, the main inverted component yi[n] does not fully cancel the external noise XA due to the presence of an angle though the direction of the main inverted component yi[n] is roughly opposite to the direction of the external noise XA.

Since the main inverted component yi[n] and the auxiliary inverted component yq[n] substantially have the same amplitudes and substantially have orthogonal phases, the main inverted component yi[n] and the auxiliary inverted component yq[n] can be combined in an effective way to generate the inverted signal yc[n] that has the direction opposite to the external noise XA and has the same amplitude as the external noise XA.

As a result, the audio playback device 1 can generate the inverted signal yc[n] that includes the main inverted component yi[n] and the auxiliary inverted component yq[n] having the same amplitudes and orthogonal phases by using the fixed-coefficient filtering circuit 110 and perform adjustment according to the adjusting parameters generated by the adjusting circuit 150 to accomplish the noise cancelling mechanism that can not only cancel the external noise efficiently but also has an adaptive adjusting mechanism.

Figure 4:
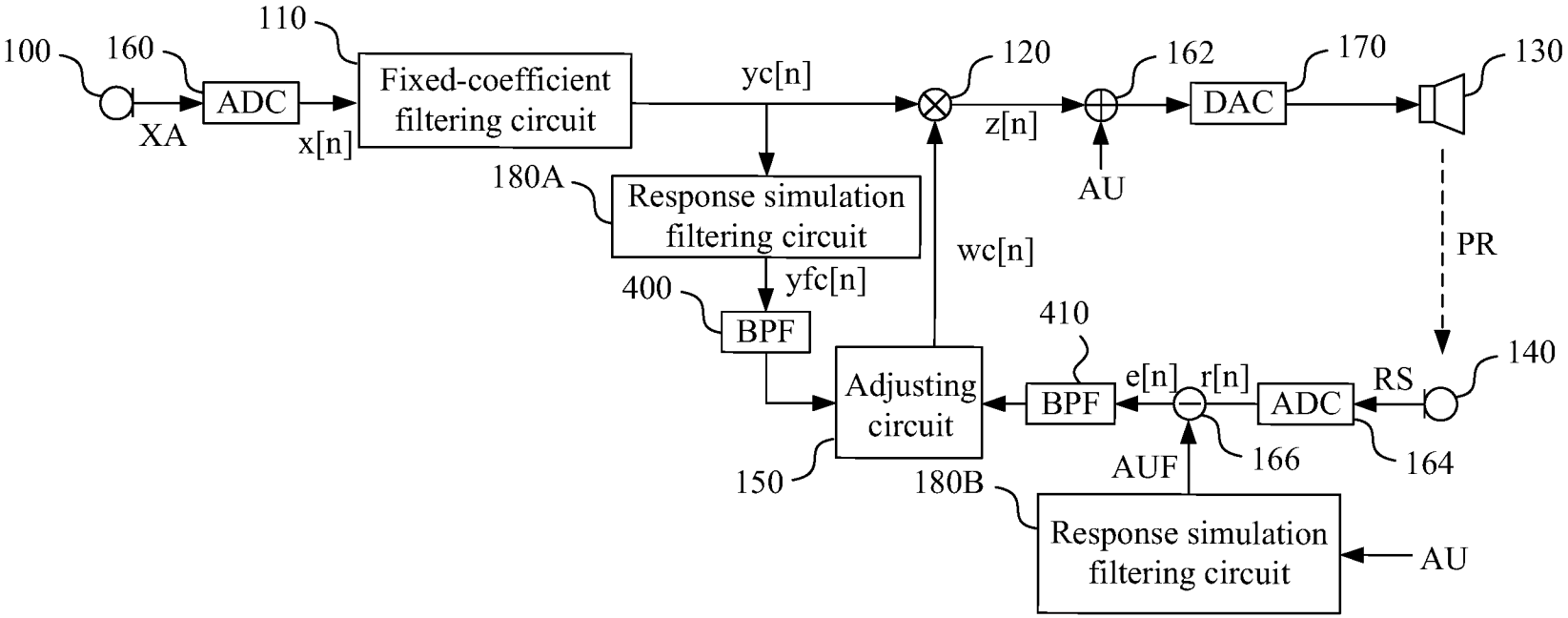
FIG. 4 is a block diagram of an audio playback device having noise-cancelling mechanism in an embodiment of the present invention.

Reference is now made to FIG. 4. FIG. 4 is a block diagram of an audio playback device 4 having noise-cancelling mechanism in an embodiment of the present invention.

The audio playback device 4 is actually the same as the audio playback device 1 illustrated in FIG. 1B and includes the external sound-receiving circuit 100, the fixed-coefficient filtering circuit 110, the operation circuit 120, the audio playback circuit 130, the internal sound-receiving circuit 140 and the adjusting circuit 150. However, in the present embodiment, the audio playback device 4 further includes a first band-pass filter 400 and a second band-pass filter 410 (respectively labeled as BPF in FIG. 4).

The first band-pass filter 400 is configured to perform filtering on the inverted signal yfc[n] within a specific frequency band. The second band-pass filter 410 is configured to perform filtering on the error signal e[n] within the specific frequency band. In an embodiment, the specific frequency band can range from such as, but not limited to 200 Hz to 1000 Hz.

The adjusting circuit 150 is substantially configured to generate the adjusting parameters wc[n] according to the filtered error signal wc[n] and the filtered inverted signal yfc[n]. By using the filtering mechanism, the audio playback device 4 can converge the filtering result to the specific frequency band.

Figure 5:
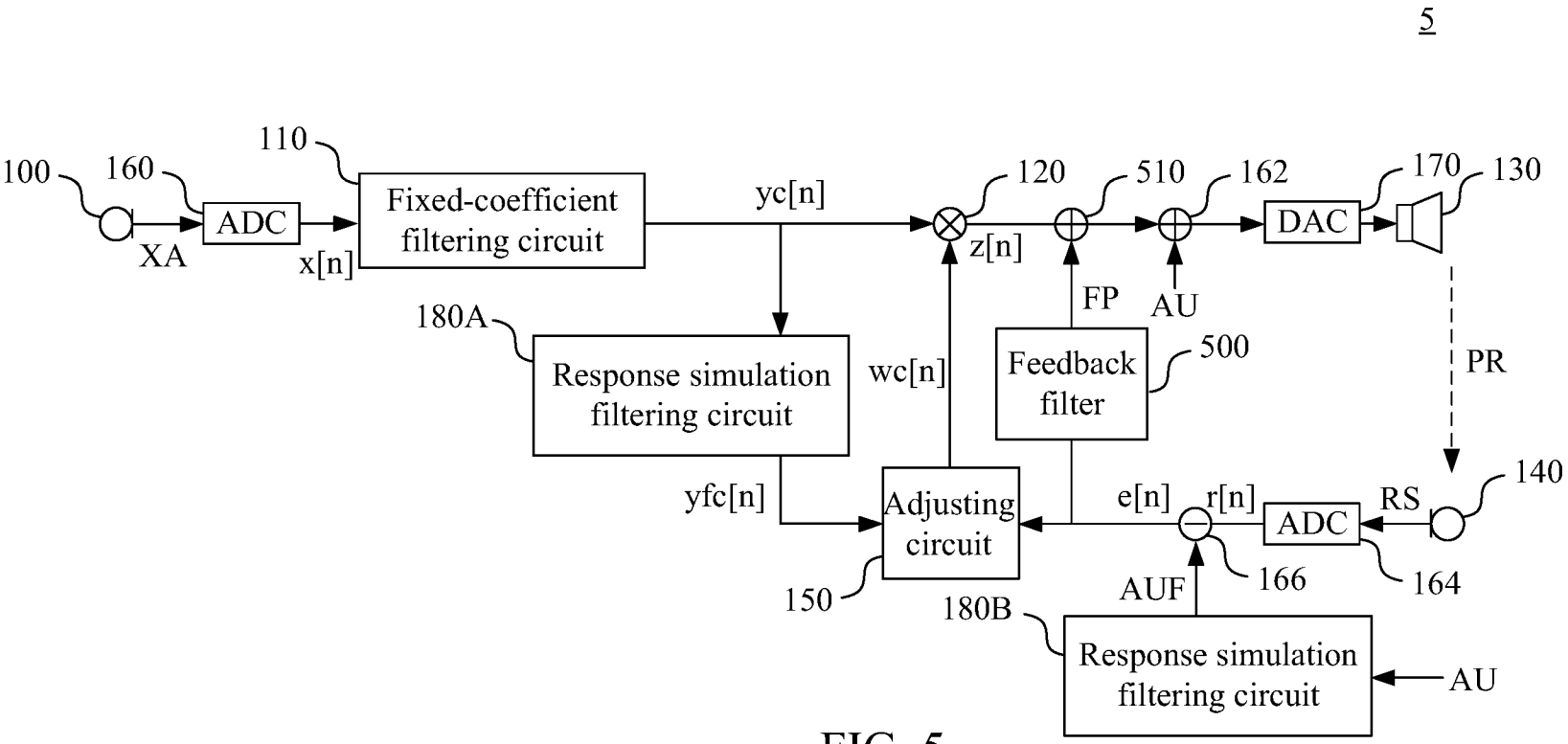
FIG. 5 is a block diagram of an audio playback device having noise-cancelling mechanism in an embodiment of the present invention.

Reference is now made to FIG. 5. FIG. 5 is a block diagram of an audio playback device 5 having noise-cancelling mechanism in an embodiment of the present invention.

The audio playback device 5 is actually the same as the audio playback device 1 illustrated in FIG. 1B and includes the external sound-receiving circuit 100, the fixed-coefficient filtering circuit 110, the operation circuit 120, the audio playback circuit 130, the internal sound-receiving circuit 140 and the adjusting circuit 150. However, in the present embodiment, the audio playback device 5 further includes a feedback filter 500 and an adder 510.

The feedback filter 500 is configured to perform a feedback filtering on the error signal e[n] when the internal sound-receiving circuit 140 has noise to further adjust the adjusted inverted signal z[n] by using the adder 510. Further, the audio signal AU and the adjusted inverted signal z[n] adjusted according to the feedback mechanism are added by the adder 162 and are transmitted to the audio playback circuit 130. As a result, by disposing the feedback filter 500, the audio playback device 5 can have both the feed-forward and the feedback adjusting mechanism to further reduce the effect of the noise.

Figure 6:
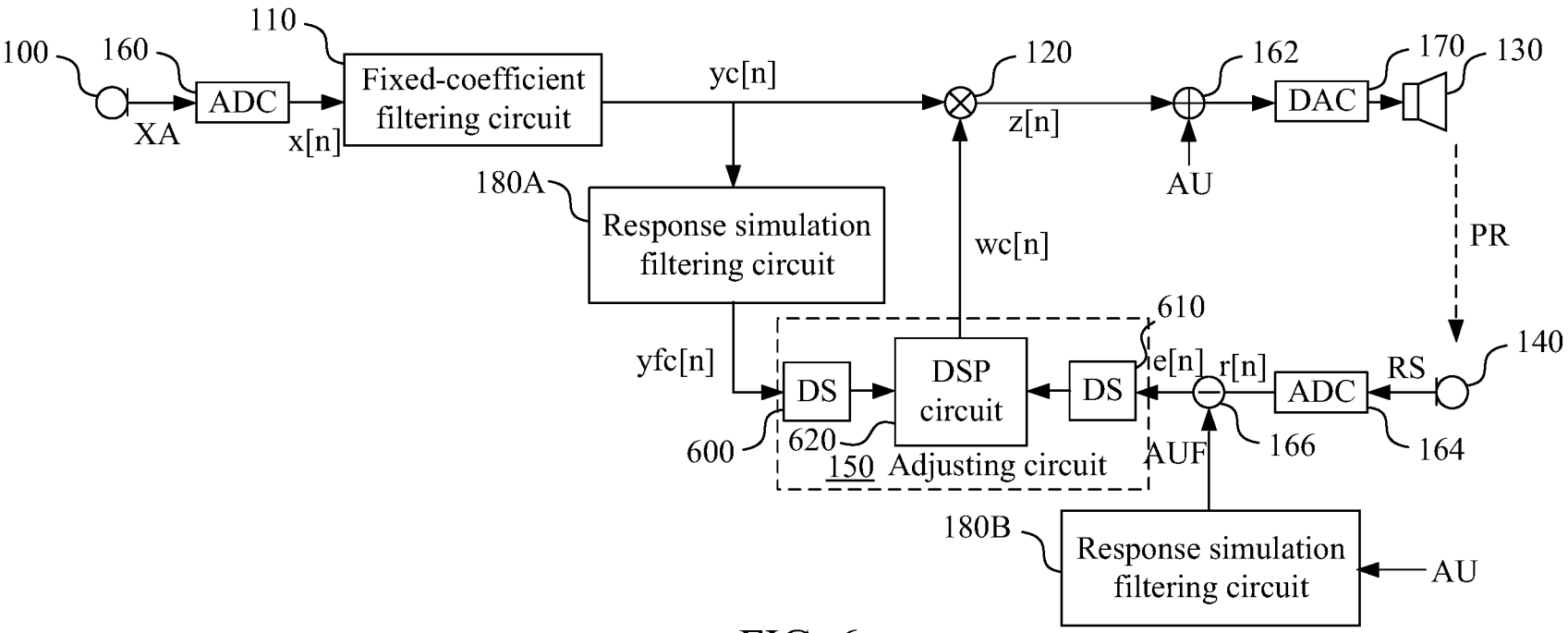
FIG. 6 is a block diagram of an audio playback device having noise-cancelling mechanism in an embodiment of the present invention.

Reference is now made to FIG. 6. FIG. 6 is a block diagram of an audio playback device 6 having noise-cancelling mechanism in an embodiment of the present invention.

The audio playback device 6 is actually the same as the audio playback device 1 illustrated in FIG. 1B and includes the external sound-receiving circuit 100, the fixed-coefficient filtering circuit 110, the operation circuit 120, the audio playback circuit 130, the internal sound-receiving circuit 140 and the adjusting circuit 150. However, in the present embodiment, the audio playback device 6 further includes a first down-sampling circuit 600, a second down-sampling circuit 610 (respectively labeled as DS in FIG. 6) and a digital signal processing circuit 620.

The first down-sampling circuit 600 is configured to perform down-sampling on the filtered inverted signal yfc[n]. The second down-sampling circuit 610 is configured to perform down-sampling on the error signal e[n]. The digital signal processing circuit 620 is configured to generate the group of adjusting parameters wc[n] according to the down-sampled error signal e[n], the down-sampled main inverted component yfi[n] and the down-sampled auxiliary inverted component yfq[n]. By down-sampling, the digital signal processing circuit 620 can lower the frequency and operate in a low speed condition to generate the adjusting parameters wc[n].

Figure 7:
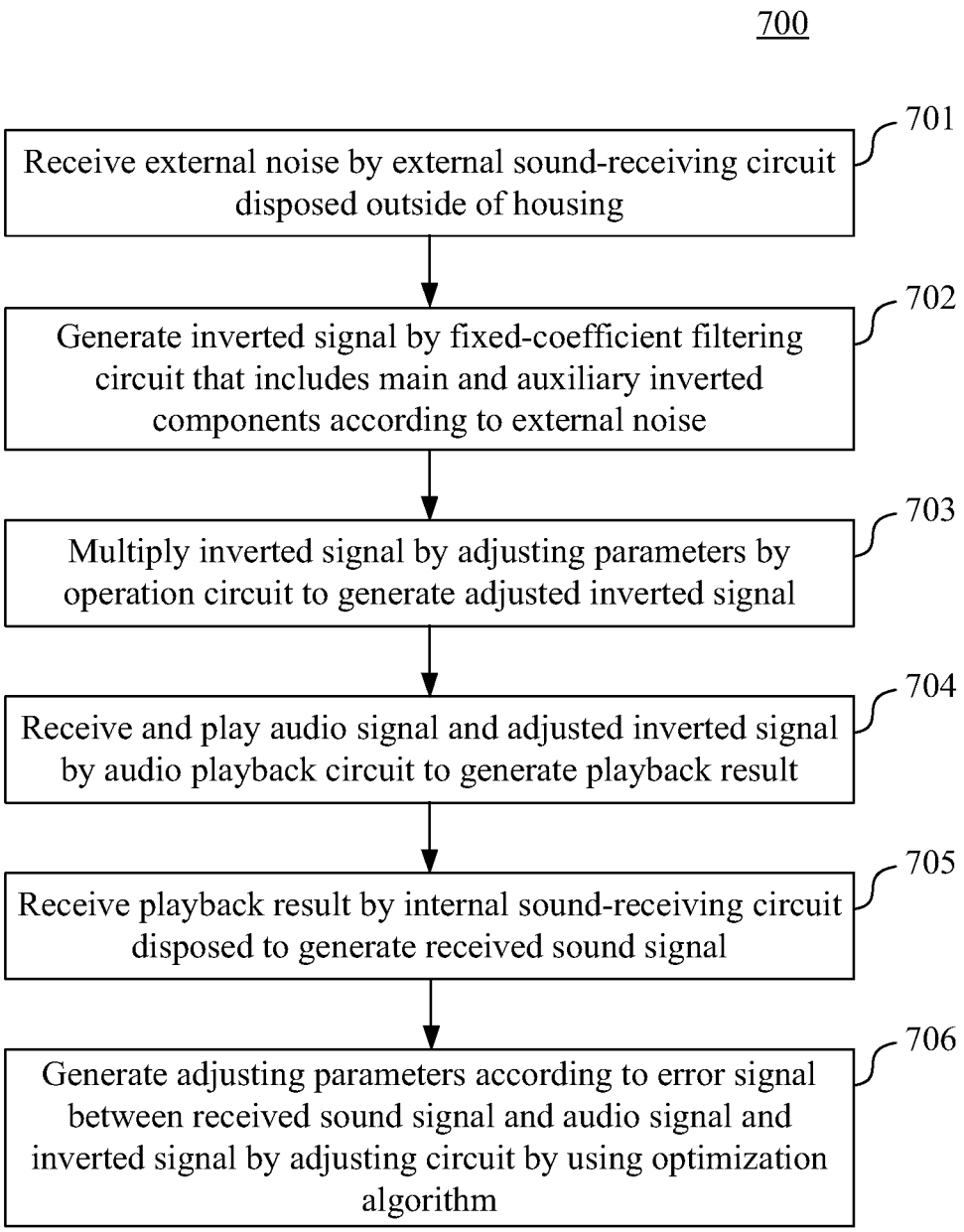
FIG. 7 is a flow chart of an audio playback method having the noise-cancelling mechanism in an embodiment of the present invention.

Reference is now made to FIG. 7. FIG. 7 is a flow chart of an audio playback method 700 having the noise-cancelling mechanism in an embodiment of the present invention. The audio playback method 700 can be used in the audio playback device 1 illustrated in FIG. 1A or FIG. 1B. The following description is made by using the audio playback device 1 illustrated in FIG. 1A as the example.

The audio playback method 700 includes the steps outline below (The operations are not recited in the sequence in which the operations are performed. That is, unless the sequence of the operations is expressly indicated, the sequence of the operations is interchangeable, and all or part of the steps may be simultaneously, partially simultaneously, or sequentially performed).

In step 701, external noise XA is received by the external sound-receiving circuit 100 disposed outside of the housing.

In step 702, the inverted signal yc[n] is generated by a fixed-coefficient filtering circuit 110 that includes the main inverted component yi[n] and the auxiliary inverted component yq[n] having amplitudes that are substantially the same and phases that are substantially orthogonal to each other according to the external noise XA.

In step 703, the inverted signal yc[n] is multiplied by the group of adjusting parameters wc[n] by an operation circuit 120 to generate the adjusted inverted signal z[n], wherein the group of adjusting parameters z[n] includes the first adjusting parameter wi[n] configured to adjust the main inverted component yi[n] and the second adjusting parameter wq[n] configured to adjust the auxiliary inverted component yq[n].

In step 704, the audio signal AU and the adjusted inverted signal z[n] are received and played by the audio playback circuit 130 disposed inside of the housing to generate the playback result PR.

In step 705, the playback result PR is received by the internal sound-receiving circuit 140 disposed inside the housing to generate a received sound signal r[n].

In step 706, the adjusting parameters wc[n] are generated according to the error signal e[n] between the received sound signal r[n] and the audio signal AU and the inverted signal yc[n] by the adjusting circuit 150 by using the optimization algorithm.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An audio playback device having a noise-cancelling mechanism, comprising:

an external sound-receiving circuit disposed outside of a housing and configured to receive external noise;

a fixed-coefficient filtering circuit configured to generate an inverted signal comprising a main inverted component and an auxiliary inverted component having amplitudes that are substantially the same and phases that are substantially orthogonal to each other according to the external noise;

an operation circuit configured to multiply the inverted signal by a group of adjusting parameters to generate an adjusted inverted signal, wherein the group of adjusting parameters comprise a first adjusting parameter configured to adjust the main inverted component and a second adjusting parameter configured to adjust the auxiliary inverted component;

an audio playback circuit disposed inside of the housing and configured to receive and playback an audio signal and the adjusted inverted signal to generate a playback result;

an internal sound-receiving circuit disposed inside the housing and configured to receive the playback result to generate a received sound signal; and an adjusting circuit configured to generate the adjusting parameters according to an error signal between the received sound signal and the audio signal and the inverted signal by using an optimization algorithm.

2. The audio playback device of claim 1, wherein the main inverted component is generated according to a first path response from the external sound-receiving circuit to the audio playback circuit and a second path response from the audio playback circuit to the internal sound-receiving circuit.

3. The audio playback device of claim 1, further comprising:

a first response simulation filtering circuit configured to filter the inverted signal according to a frequency response from the audio playback circuit to the internal sound-receiving circuit to generated a filtered inverted signal; and a second response simulation filtering circuit configured to filter the audio signal according to the frequency response to generate a filtered audio signal;

wherein the adjusting circuit is substantially configured to generate the adjusting parameters according to the error signal between the received sound signal and the filtered audio signal and the filtered inverted signal by using the optimization algorithm.

4. The audio playback device of claim 1, wherein the optimization algorithm is a least mean square (LMS) algorithm, and the adjusting circuit is a LMS algorithm processing circuit.

5. The audio playback device of claim 1, wherein the adjusting circuit comprises:

a first down-sampling circuit configured to perform down-sampling on the inverted signal;

a second down-sampling circuit configured to perform down-sampling on the error signal; and a digital signal processing circuit configured to generate the group of adjusting parameters according to the down-sampled error signal and the down-sampled inverted signal.

6. The audio playback device of claim 1, further comprising:

a first band-pass filter configured to perform filtering on the inverted signal within a specific frequency band; and a second band-pass filter configured to perform filtering on the error signal within the specific frequency band;

wherein the adjusting circuit is substantially configured to generate the adjusting parameters according to the filtered error signal and the filtered inverted signal.

7. The audio playback device of claim 6, wherein the specific frequency band ranges from 200 Hz to 1000 Hz.

8. The audio playback device of claim 1, further comprising a feedback filter configured to perform a feedback filtering on the error signal to further adjust the adjusted inverted signal.

9. The audio playback device of claim 1, further comprising:

a first analog to digital conversion circuit configured to perform analog to digital conversion on the external noise and transmit the converted external noise to the fixed-coefficient filtering circuit;

a second first analog to digital conversion circuit configured to perform analog to digital conversion on the received sound signal and transmit the converted received sound signal to the adjusting circuit; and a digital to analog conversion circuit configured to perform digital to analog conversion on the audio signal and the adjusted inverted signal and transmit the converted audio signal and the adjusted inverted signal to the audio playback circuit.

10. An audio playback method having a noise-cancelling mechanism used in an audio playback device, comprising:

receiving external noise by an external sound-receiving circuit disposed outside of a housing;

generating an inverted signal by a fixed-coefficient filtering circuit that comprises a main inverted component and an auxiliary inverted component having amplitudes that are substantially the same and phases that are substantially orthogonal to each other according to the external noise;

multiplying the inverted signal by a group of adjusting parameters by an operation circuit to generate an adjusted inverted signal, wherein the group of adjusting parameters comprise a first adjusting parameter configured to adjust the main inverted component and a second adjusting parameter configured to adjust the auxiliary inverted component;

receiving and playing an audio signal and the adjusted inverted signal by an audio playback circuit disposed inside of the housing to generate a playback result;

receiving the playback result by an internal sound-receiving circuit disposed inside the housing to generate a received sound signal; and generating the adjusting parameters according to an error signal between the received sound signal and the audio signal and the inverted signal by an adjusting circuit by using an optimization algorithm.

* * * * *